US006971435B2

(12) United States Patent
Rasmussen

(10) Patent No.: US 6,971,435 B2
(45) Date of Patent: Dec. 6, 2005

(54) RAISING AND LOWERING MECHANISM, IN PARTICULAR FOR ROLLER BLINDS

(75) Inventor: Ken Rasmussen, Ringe (DK)

(73) Assignee: A/S Chr. Fabers Fabriker, Ryslinge (DK)

( * ) Notice: Subject to any disclaimer, the term of this patent is extended or adjusted under 35 U.S.C. 154(b) by 0 days.

(21) Appl. No.: 10/398,684

(22) PCT Filed: Oct. 15, 2001

(86) PCT No.: PCT/DK01/00678

§ 371 (c)(1),
(2), (4) Date: Oct. 21, 2003

(87) PCT Pub. No.: WO02/33210

PCT Pub. Date: Apr. 25, 2002

(65) Prior Publication Data

US 2004/0050505 A1 Mar. 18, 2004

(30) Foreign Application Priority Data

Oct. 13, 2000 (DK) ..... 2000 01534

(51) Int. Cl.[7] ..... A47G 5/02
(52) U.S. Cl. ..... 160/321; 160/178.1 R; 160/320
(58) Field of Search ..... 160/321, 178.1 R, 160/120, 168.1 R, 319, 320, 323.1, 171 R, 160/344, 345, 178.1 V; 475/178

(56) References Cited

U.S. PATENT DOCUMENTS

| | | | | |
|---|---|---|---|---|
| 1,417,298 | A * | 5/1922 | Brock | 160/298 |
| 1,547,035 | A * | 7/1925 | Hawthorne, Sr. | 280/240 |
| 1,591,104 | A * | 7/1926 | Robinson | 160/298 |
| 2,577,046 | A * | 12/1951 | Bennett | 160/321 |
| 4,139,044 | A * | 2/1979 | Brolin | 160/321 |
| 4,424,852 | A * | 1/1984 | Hopper | 160/309 |
| 4,475,580 | A | 10/1984 | Hennequin | |
| 4,865,109 | A * | 9/1989 | Sherman | 160/321 |
| 5,009,259 | A | 4/1991 | Miloslaus | |
| 5,029,629 | A * | 7/1991 | Cheng-Pei | 160/300 |
| 5,092,389 | A * | 3/1992 | Tedeschi | 160/321 |
| 5,137,073 | A * | 8/1992 | Huang | 160/321 |
| 5,232,038 | A * | 8/1993 | Buxbaum | 160/308 |
| 5,542,464 | A | 8/1996 | Shiina | |
| 5,975,186 | A * | 11/1999 | Day | 160/321 |
| 6,048,285 | A * | 4/2000 | Chou | 474/199 |
| 6,161,607 | A * | 12/2000 | de Kimpe et al. | 160/238 |
| 6,164,428 | A * | 12/2000 | Berman et al. | 192/223.4 |
| 6,173,825 | B1 * | 1/2001 | Liu | 192/223.4 |
| 6,250,359 | B1 * | 6/2001 | Lorio et al. | 160/178.1 V |
| 6,505,668 | B1 * | 1/2003 | Fun | 160/311 |
| 6,749,000 | B2 * | 6/2004 | Bohlen | 160/321 |
| 2002/0056530 | A1 * | 5/2002 | Butler | 160/241 |
| 2003/0085003 | A1 * | 5/2003 | Cheng | 160/321 |
| 2004/0099384 | A1 * | 5/2004 | Wu | 160/321 |

FOREIGN PATENT DOCUMENTS

SE 504777 C2 4/1997

* cited by examiner

*Primary Examiner*—Bruce A. Lev
(74) *Attorney, Agent, or Firm*—Pearne & Gordon LLP

(57) ABSTRACT

The operation of a roller blind occurs via a ball cord and a pulley. The ball cord may be wound several turns around the pulley, in that oblong axial tracks have been provided in the pulley. Thereby the winding may be preserved without jamming between the windings. Greater forces may be transmitted to the pulley than in case of known constructions.

9 Claims, 2 Drawing Sheets

8
5
10
4
3
9
1

RAISING AND LOWERING MECHANISM, IN PARTICULAR FOR ROLLER BLINDS

A raising and lowering mechanism, in particular for roller blinds.

This application claims the benefit of International Application No. PCT/DK01/00678, which was published in English on Apr. 25, 2002.

The invention relates to a raising and lowering mechanism, in particular for roller blinds which use endless ball cords. When one end of the dangling part of such a ball cord is pulled, a pulley is rotated which is provided with pockets for the balls whereby it has the appearence of a kind of chain wheel. Slipping of the ball cord is thereby avoided. The pulley is connected to a drum or a carrier tube around which the roller blind is rolled. When one of the dangling parts is pulled, the roller blind is raised against the resistance created by the roller blind, and when the other part is pulled the roller blind is again lowered. Fixing in a desired condition is obtained by latching a ball on the ball cord under a catch which may be fastened to a window frame.

In case of heavy roller blinds the load on the individual separators between the pockets on the pulley (corresponding to sprockets in a chain wheel) becomes very severe, in particular in case of a small diameter, and it reduces the utility of this construction. It makes the use of a friction device for fixing without the use of a catch more difficult. It is the purpose of the invention to provide a construction which transmits the forces from a pull in the ball cord to the pulley in a more efficient manner.

This is obtained according to the invention in that the ball cord is wound at least 1½ times around the pulley which is designed with increased width and in which the pockets for receiving the balls have an enlarged axial extent. Hereby a force is transmitted from a larger number of balls, and simultaneously an axial displacement of the two ball cords which makes it easier to distinguish them from one another when the correct one has to be chosen for raising or lowering.

In an advantageous embodiment there is mounted a body parallel to the axis of the pulley at a distance from the edge of the pulley which is less than the diameter of a ball and with an axial extent corresponding to that of the pulley. Hereby it is achieved that the ball cord which has been wound during assembly cannot be removed from the pulley, irrespective of any position assumed by the roller blind. When it is mounted on e.g. a pivot-hung window it is essential that the operation is not influenced by the instant angular position of the window.

In a further advantageous embodiment of the invention the ball cord is wound several times (plus ½) around the pulley. Hereby a well-defined further displacement of the vertical placement is obtaind, and there is simultaneously the possibility to reduce the assortment of endless ball cords, because superfluous lenghts of ball cord may simply be wound around the pulley (which should properly be termed drum when there is space for many windings) during mounting.

The invention will be described in greater detail with reference to the drawing, which in perspective representation shows the following:

FIG. 1*a* shows the spatial arrangement of a ball cord,

FIG. 1*b* shows the corresponding pulley,

None of the figures shows fittings or the like which are used in the normal manner to fix the mechanism to the surface which is to be covered by the roller blind.

Figure 1:
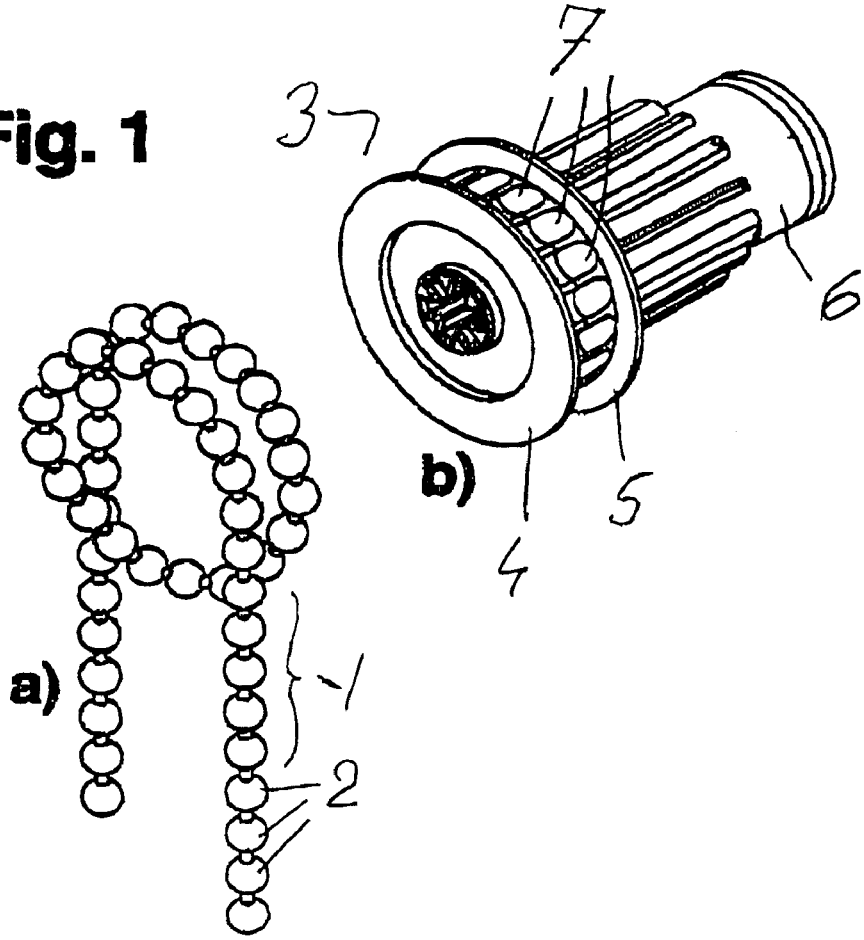

In FIG. 1*a* is seen the upper end of a ball cord 1 comprising balls 2 which are fastened at a distance to a cord which does not need to be endless to work in the invention, and it is seen how 1½ winding have been created without crossing. In FIG. 1*b* is seen the corresponding pulley with flanges 4 and 5 and the insert which is to be connected to the carrier tube for the roller blind, and it is seen that the pockets 7 are shaped to have length corresponding to two balls 2 placed side by side. There is such a relation between the diameter of the pulley and the distance between the balls on the ball cord that a winding at all times corresponds to having the balls lying on cylinder generatrices. However, nothing in principle prevents that the pockets may be placed on parts of helices which provides complete freedom of choice in the relation between ball distance and pulley diameter.

Figure 2:
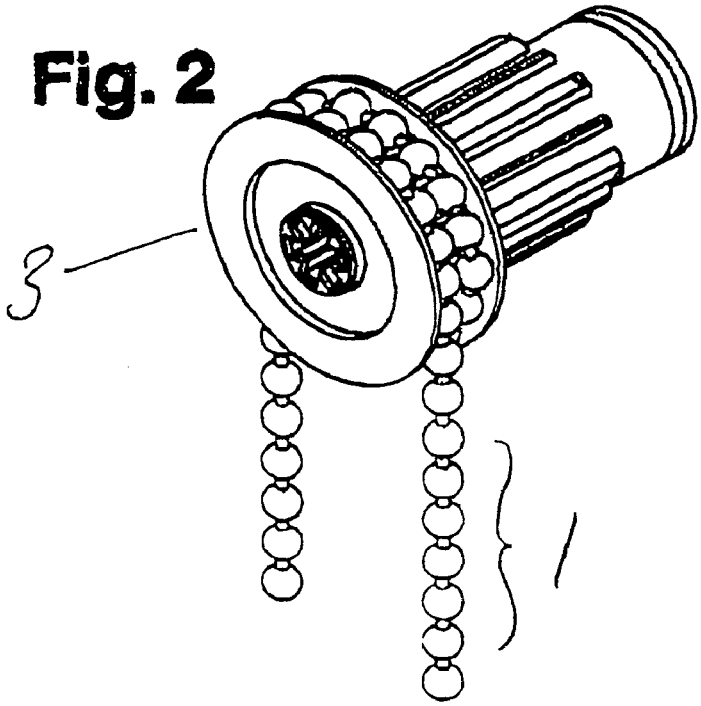
FIG. 2 shows the ball cord fitted to the pulley.

In FIG. 2 is seen the ball cord 1 which is wound around the pulley 3, i.e. the combination of FIGS. 1*a* and 1*b*. When the ball cord is pulled there happens all the time a shifting of the balls from one side of a pocket to the other, but without problems with jamming which would happen if an ordinary cord were used.

Figure 3:
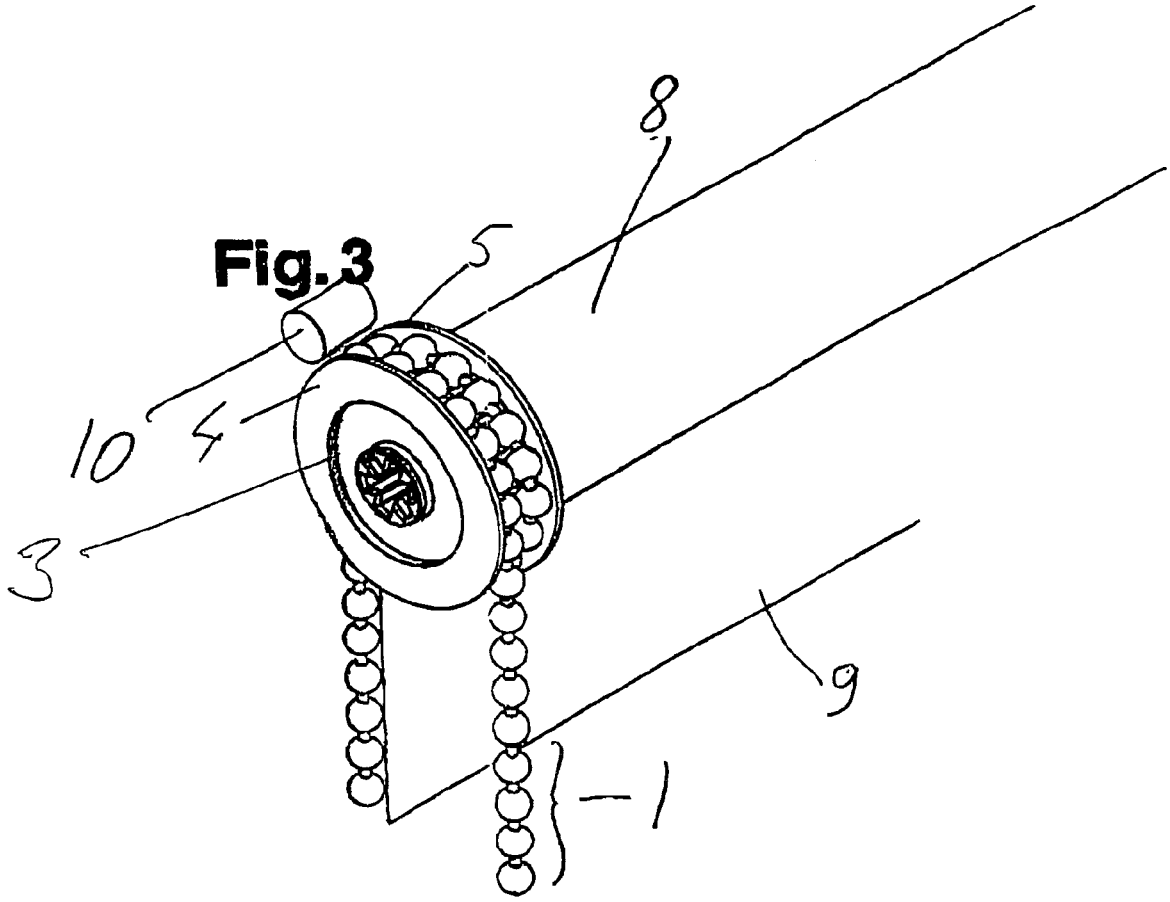
FIG. 3 shows the pulley with a ball cord and a partly raised roller blind.

In FIG. 3 is seen a roller blind 8 which is partly raised and with a hanging end 9. Furthermore a body 10 is seen which is fitted outside the pulley 3 and which prevents the ball cord 1 from moving past the flanges 4 and 5 of the pulley and getting unwound from the pulley.

What is claimed is:

1. A raising and lowering mechanism for roller blinds comprising:

an endless ball cord;

a pulley with pockets for receiving the endless ball cord; and a carrier tube that is rotatable by the pulley, wherein the endless ball cord is wound at least 1½ times around the pulley, and wherein the pockets have an axial extent greater than a diameter of a ball on the endless ball cord.

2. The raising and lowering mechanism of claim 1, wherein the endless ball cord is wound several times plus ½ times around the pulley.

3. The raising and lowering mechanism of claim 1, wherein the pockets have an axial extent greater than 1½ times the diameter of the ball.

4. The raising and lowering mechanism of claim 1, wherein the pockets have an axial extent greater than two times the diameter of the ball.

5. A raising and lowering mechanism for roller blinds comprising:

a ball cord;

a pulley for receiving the ball cord; and a carrier rube that is rotatable by the pulley, wherein the ball cord is wound at least 1½ times around the pulley, the pulley having a width that is at least 1½ times a diameter of a ball on the ball cord.

6. The raising and lowering mechanism of claim 5, wherein the pulley comprises two flanges adapted to retain the ball cord within the width area of the pulley.

7. The raising and lowering mechanism of claim 5, wherein the pulley includes a plurality of pockets axially extending around a diameter of the pulley.

8. The raising and lowering mechanism of claim 7, wherein the plurality of pockets have an axial length that is at least two times the diameter of the ball on the ball cord.

9. The raising and lowering mechanism of claim 5, wherein the ball cord is an endless ball cord.

* * * * *